US011346221B2

(12) United States Patent
Moon et al.

(10) Patent No.: US 11,346,221 B2
(45) Date of Patent: May 31, 2022

(54) BACKPRESSURE PASSAGE ROTARY COMPRESSOR

(71) Applicant: LG ELECTRONICS INC., Seoul (KR)

(72) Inventors: Seokhwan Moon, Seoul (KR); Seoung-Min Kang, Seoul (KR); Kiyoul Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 182 days.

(21) Appl. No.: 16/241,160

(22) Filed: Jan. 7, 2019

(65) Prior Publication Data

US 2019/0211681 A1 Jul. 11, 2019

(30) Foreign Application Priority Data

Jan. 8, 2018 (KR) ..... 10-2018-0002348

(51) Int. Cl.
*F01C 21/08* (2006.01)
*F01C 1/344* (2006.01)
(Continued)

(52) U.S. Cl.
CPC ..... *F01C 21/0809* (2013.01); *F01C 21/0863* (2013.01); *F04C 18/344* (2013.01); *F04C 18/3446* (2013.01); *F04C 29/12* (2013.01)

(58) Field of Classification Search
CPC ..... F01C 21/0809; F01C 1/3441; F01C 21/0863; F01C 1/3442; F25B 1/04;
(Continued)

(56) References Cited

U.S. PATENT DOCUMENTS 3,221,665 A * 12/1965 Hartmann ..... F04C 14/223 418/27
4,913,636 A * 4/1990 Niemiec ..... F01C 21/0863 418/133
(Continued)

FOREIGN PATENT DOCUMENTS

EP 0 695 854 2/1996
FR 2095507 A5 * 2/1972 ..... F04C 14/26
(Continued)

OTHER PUBLICATIONS

English Machine Translation of FR2095507A5, Translated on Jan. 26, 2021 (Year: 1972).*
(Continued)

*Primary Examiner* — Mary Davis
*Assistant Examiner* — Paul W Thiede
(74) *Attorney, Agent, or Firm* — Ked & Associates LLP

(57) ABSTRACT

A backpressure rotary compressor may include at least one vane, at least one vane slot configured to accommodate the at least one vane and provided with a pocket portion and a slide portion, and a backpressure passage provided with a backpressure inlet disposed in front of the at least one vane slot and a backpressure outlet formed in the pocket portion. The backpressure passage may perform a role of allowing a compression chamber and the pocket portion to communicate with each other. According to the backpressure passage rotary compressor, proper pressure may be supplied to an inner end of the vane, thereby reducing a mechanical loss caused by pressure occurring in a close contact portion between an outer end of the at least one vane and an inner circumferential surface of the cylinder, and achieving high efficiency in relation to driving a device.

12 Claims, 16 Drawing Sheets

(51) Int. Cl.

| | |
|---|---|
| ***F25B 1/04*** | (2006.01) |
| ***F04C 18/344*** | (2006.01) |
| ***F04C 28/22*** | (2006.01) |
| ***F04C 29/12*** | (2006.01) |

(58) Field of Classification Search
CPC .. F04C 18/3446; F04C 23/008; F04C 14/223; F04C 14/26
See application file for complete search history.

(56) References Cited

U.S. PATENT DOCUMENTS

| | | | | |
|---|---|---|---|---|
| 5,947,712 | A * | 9/1999 | Viegas | F01C 1/3442 418/152 |
| 2013/0084202 | A1* | 4/2013 | Takahashi | F04C 23/008 418/209 |
| 2014/0271310 | A1 | 9/2014 | Whitesel | |

FOREIGN PATENT DOCUMENTS

| | | |
|---|---|---|
| JP | 58-117382 | 7/1983 |
| JP | 59-5990790 | 5/1984 |

OTHER PUBLICATIONS

European Search Report dated Mar. 19, 2019.
Korean Office Action issued in Application No. 10-2018-00022348 dated Jan. 12, 2022.

* cited by examiner

BACKPRESSURE PASSAGE ROTARY COMPRESSOR

CROSS-REFERENCE TO RELATED APPLICATION(S)

This application claims priority under 35 U.S.C. § 119 to Korean Application No. 10-2018-0002348, filed in Korea on Jan. 8, 2018, whose entire disclosure is herein incorporated by reference.

BACKGROUND

1. Field

A backpressure passage rotary compressor provided with a backpressure passage is disclosed herein.

2. Background

A compressor is applied to a vapor compression type refrigeration cycle, such as a refrigerator or an air conditioner, for example. The compressor may be classified into an indirect suction type and a direct suction type according to a method for suctioning a refrigerant into a compression chamber.

The indirect suction type is a type in which a refrigerant circulating through a refrigeration cycle is suctioned into the compression chamber after being introduced into an inner space of a case of the compressor, and the direct suction type is a type in which the refrigerant is directly suctioned into the compression chamber, unlike the indirect suction type. The indirect suction type may be referred to as a "low-pressure type compressor" and the direct suction type may be referred to as a "high-pressure type compressor".

The low-pressure type compressor is not provided with an accumulator as a liquid refrigerant or oil is filtered in the inner space of the case of the compressor as the refrigerant first flows into the inner space of the case of the compressor. Conversely, the high-pressure type compressor is provided with an accumulator on a suction side rather than the compression chamber in order to prevent the liquid refrigerant or oil from flowing into the compression chamber.

The compressor may be divided into a rotary type and a reciprocating type according to how to compress a refrigerant. The rotary type compressor is a type in which a volume of the compression chamber is varied by a rolling piston (hereinafter, referred to as "a roller") that rotates or performs a turning movement in a cylinder. The reciprocating type compressor is a type in which a volume of the compression chamber is varied by a roller that reciprocates in the cylinder.

There is provided a rotary compressor configured to compress the refrigerant using a rotational force of a drive portion as an example of the rotary type compressor. Recently, technology development mainly aims to increase efficiency of the rotary compressor while making it smaller. Further, studies for obtaining a larger cooling capacity by increasing a variable range of operation speed of a miniaturized rotary compressor have been continuously conducted.

The rotary compressor includes a drive motor and a compression unit disposed in a case configured to form an exterior, and compresses a suctioned refrigerant and then discharges the compressed refrigerant. The drive motor includes a rotor and a stator disposed in this order with respect to a rotational shaft. When power is applied to the stator, the rotor rotates in the stator while rotating the rotational shaft.

The compression unit includes a cylinder configured to form a compression chamber, a roller coupled to the rotational shaft, and a vane configured to partition the compression chamber into a plurality of chambers. In the cylinder, there is provided a roller configured to form a plurality of compression spaces together with the vane while rotating with respect to the rotational shaft. The roller performs a rotational motion concentrically with the rotational shaft.

A plurality of vane slots is provided radially on an outer circumferential surface of the roller, and each vane slidably protrudes from the vane slot. Each vane protrudes from the vane slot by backpressure of oil formed at a rear end thereof and a centrifugal force caused by rotation of the roller, and is brought into close contact with an inner circumferential surface of the cylinder, thereby compressing refrigerants accommodated in an inner space of the cylinder.

At this time, pressure occurs in a close contact portion between an outer end of the vane and the inner circumferential surface of the cylinder. In this case, pressure of pushing the vane at an inner end of the vane of an airtight compressor determines the pressure occurring in the close contact portion between the outer end of the vane and the inner circumferential surface of the cylinder.

In a conventional rotary compressor, pressure in a space where the pressure is formed is maintained at an intermediate-pressure level and a high-pressure level, and thus, it is difficult to apply an appropriate level of pressure. That is, an interval in which an excessive magnitude of pressure is applied although it is lower than a discharge pressure occurs. The pressure occurring in the close contact portion between the outer end of the vane and the inner circumferential surface of the cylinder is a major factor affecting efficiency and reliability of a vane rotary structure, and thus, it is required to optimize the pressure occurring in the close contact portion between the outer end of the vane and the inner circumferential surface of the cylinder.

BRIEF DESCRIPTION OF THE DRAWINGS

Embodiments will be described in detail with reference to the following drawings in which like reference numerals refer to like elements, and wherein:

FIGS. 13-14 show a time point when the backpressure inlet is closed by the inner circumferential surface of the cylinder, FIG. 14 being an enlarged view of a portion indicated by the letter "E" in FIG. 13, and FIGS. 15-16 show a time point when the backpressure inlet is opened to the compression chamber of the cylinder, FIG. 16 being an enlarged view of a portion indicated by the letter portion "F" in FIG. 15.

DETAILED DESCRIPTION

Figure 1:
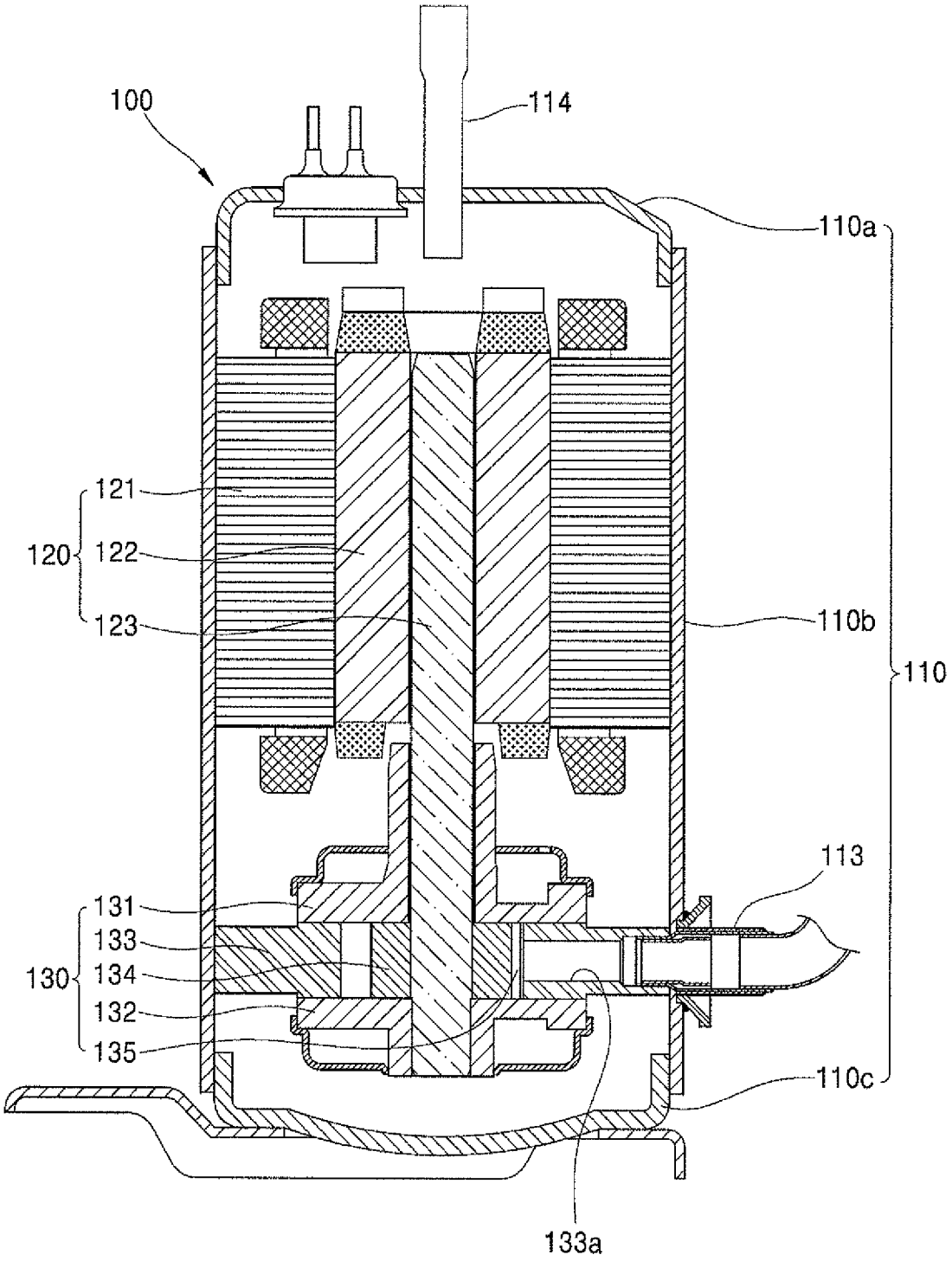
FIG. 1 is a cross-sectional view of a general internal structure of a rotary compressor.

Hereinafter, a rotary compressor according to embodiments will be described with reference to the accompanying drawings. Wherever possible like reference numerals have been used to indicate like elements and repetitive disclosure has been omitted.

A singular noun, e.g. "a," "an," "the," includes a plural of that noun unless specifically stated otherwise. In the description of embodiments, the detailed description of well-known related configurations or functions has been omitted when it has been deemed that such description will cause ambiguous interpretation embodiments.

It should be noted that that the accompanying drawings are merely provided to facilitate the understanding of the technical idea disclosed in this specification and should not be construed as limiting the technical idea, and the disclosure covers all modifications, equivalents and alternatives falling within the spirit and scope.

Figure 2:
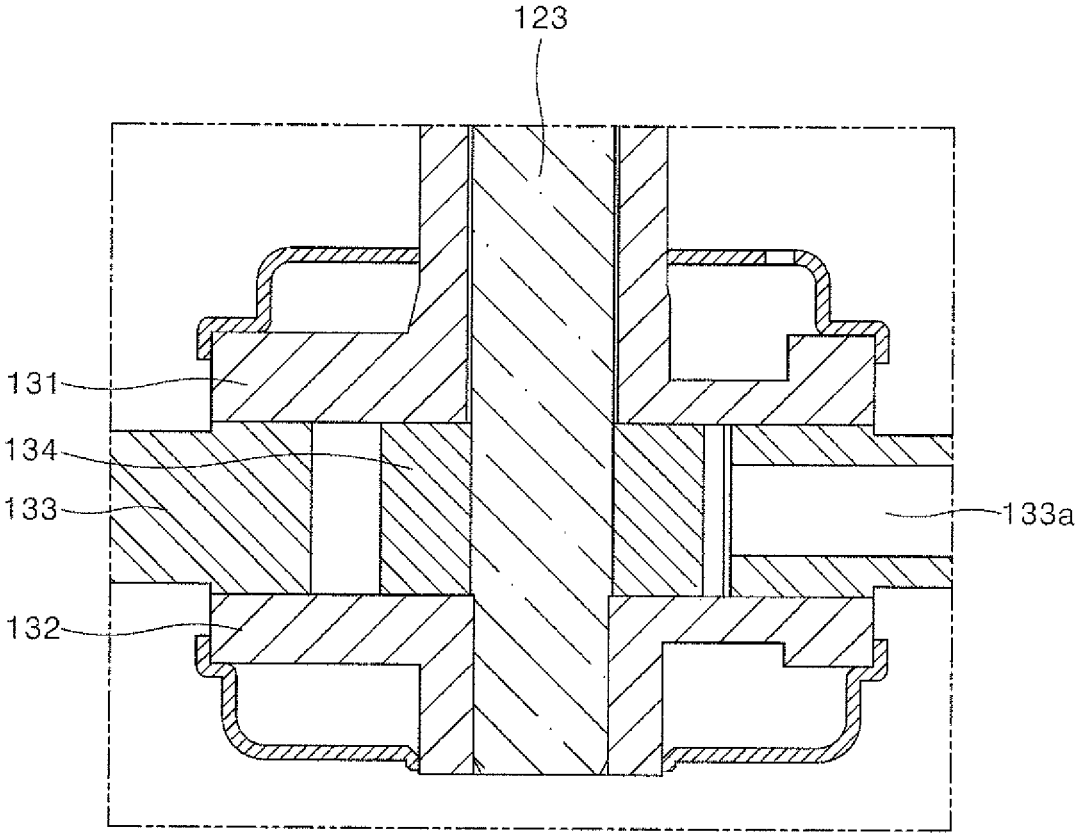
FIG. 2 is an enlarged view of an interior of the rotary compressor of FIG. 1.
Figure 3:
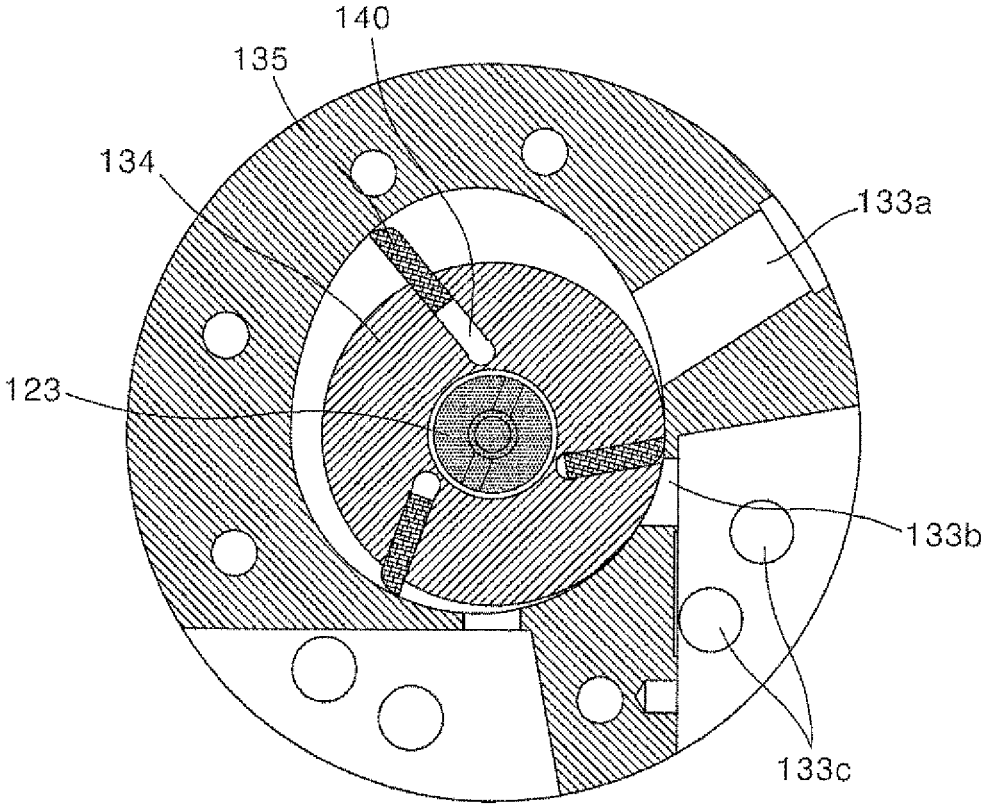
FIG. 3 is a cross-sectional view of a structure of a compression unit of the rotary compressor of FIG. 1.

FIG. 1 is a cross-sectional view of a general internal structure of a rotary compressor. FIG. 2 is an enlarged view of an interior of the rotary compressor of FIG. 1. FIG. 3 is a cross-sectional view of a structure of a compression unit 130.

As shown in FIG. 1, the rotary compressor according to embodiments may include not only a vertical type rotary compressor in which a rotational shaft extends vertically but also a horizontal type rotary compressor in which a rotational shaft extends laterally.

The rotary compressor 100 may include a case 110, a drive motor 120, and a compression unit 130. The case 110, which may form an exterior of the rotary compressor 100, may have a cylindrical shape extending along one direction, and may be formed along an extending direction of a rotational shaft 123.

A cylinder 133 configured to form a compression chamber 170 may be installed in the case 110 so as to compress suctioned refrigerants and then discharge the compressed refrigerants. The case 110 may include a first shell 110*a*, a second shell 110*b*, and a third shell 110*c*. The drive motor 120 and the compression unit 130 may be disposed on an inner surface of the second shell 110*b*. The first shell 110*a* and the third shell 110*c* may be coupled to one or a first side and the other or a second side of the second shell 110*b*, respectively.

The compression unit 130 may perform a role of compressing and discharging the refrigerant. The compression unit 130 may include a roller 134, a vane 135, the cylinder 133, a first block 131, and a second block 132.

The drive motor 120 may be disposed on one side of the compression unit 130 and may serve to provide power for compressing the refrigerant. The drive motor 120 may include a stator 121, a rotor 122, and the rotational shaft 123.

The stator 121 may be mounted on an inner circumferential surface of the cylindrical case 110 in a shrink fit manner. Further, the stator 121 may be fixed to an inner circumferential surface of the second shell 110*b*.

The rotor 122 may be spaced apart from the stator 121 and may be disposed on an inner side of the stator 121. When power is applied to the stator 121, the rotor 122 may rotate by means of a force occurring in accordance with a magnetic field formed between the stator 121 and the rotor 122, and a rotational force may be transferred to the rotational shaft 123 that passes through a center of the rotor 122.

A suction port 133*a* may be installed on one side of the second shell 110*b*. A discharge pipe 114 may be installed on one side of the first shell 110*a* so that the refrigerant flows out from an interior of the case 110.

The suction port 133*a* may be connected to a suction pipe 113. The suction pipe 113 may pass through the case 110 to be connected to an evaporator (not shown). The discharge pipe 114 may pass through the case 110 to be coupled thereto. The discharge pipe 114 may be connected to a condenser (not shown).

The compression unit 130 installed in the case 110 may compress a suctioned refrigerant and then discharge the compressed refrigerant. The suction and discharge of the refrigerant may be performed in the cylinder 133 in which the compression chamber 170 is formed.

The cylinder 133 through which the rotational shaft 123 passes may form a refrigerant accommodating space in which a refrigerant may be received in a central portion thereof, and may be provided with the suction port 133*a* and a discharge port 133*b* in a radial direction. In a process in which the refrigerant introduced through the suction port 133*a* formed in the cylinder 133 is compressed and then discharged, an end of the discharge port 133*b* may be expanded, and thereby, the compressed refrigerant may be more smoothly discharged.

In the cylinder 133, the roller 134 configured to rotate with respect to the rotational shaft 123 and form the compression chamber 170 while being in contact with the inner circumferential surface of the cylinder 133 may be installed. The roller 134 may be installed at an eccentric portion (not shown) formed in the rotational shaft 123. The roller 134 may form one contact point portion or point b on the inner circumferential surface of the cylinder 133 while rotating in the cylinder.

The roller 134 may be provided with a vane slot 140 in which the vane 135 is inserted and slidably movable. The vane slot 140 may include a pocket portion or pocket 144 arranged at an inner end thereof and a slide portion or slide 142 connected to the compression chamber 170 from the pocket portion 144.

The vane 135 may be inserted into the vane slot 140. The vane 135 may slidably move in the slide portion 142 in a state of being inserted into the vane slot 140. An outer end of the vane 135 may protrude into the compression chamber 170 due to backpressure applied from the pocket potion 144 and a centrifugal force caused by rotation. The outer end of the vane 135 may protrude into the compression chamber 170, and the compression chamber 170 formed by the cylinder 133 and the roller 134 may be partitioned by the outer end of the vane 135 that protrudes into the compression chamber 170 to be in contact with an inner circumferential surface of the cylinder 133.

The vane 135 may include a plurality of vanes 135, and the respective vanes 135 may be located to be symmetrical with respect to each other in the roller 134. The compression chamber 170 may be partitioned into a plurality of chambers by the plurality of vanes 135.

As the rotational shaft 123 rotates, each of the vanes 135 may move while rotating together with the roller 134 and being in contact with the inner circumferential surface of the cylinder 133. The compression chamber 170 may be formed between the inner circumferential surface of the cylinder 133 and an outer circumferential surface of the roller 134.

The refrigerant introduced from the suction port 133*a* by the movement of the vane 135 may be compressed, and then may move along to the discharge port 133*b*. The refrigerant may be discharged along discharge holes 133*c* respectively formed in the first block 131 and the second block 132 which may be respectively installed on one or a first side and the other or a second side of the cylinder 133.

A contact point between the cylinder 133 and the roller 134 may be maintained at a same location on the inner circumferential surface of the cylinder 133, and the outer end of the vane 135 may move along the inner circumferential surface of the cylinder 133. Thus, pressure formed in the compression chamber 170 may have a mechanism in which the pressure is continuously compressed according to a movement of the vane 135.

Pressure may occur in or at a close contact portion between the outer end of the vane 135 and the inner circumferential surface of the cylinder 133. In this case, pressure of pushing the vane 135 at the inner end of the vane 135 of the airtight compressor may determine the pressure occurring in the close contact portion between the outer end of the vane 135 and the inner circumferential surface of the cylinder 133.

The pressure occurring in the close contact portion between the outer end of the vane 135 and the inner circumferential surface of the cylinder 133 may be a major factor affecting efficiency and reliability of the rotary compressor. When an excessive magnitude of pressure occurs in the close contact portion between the outer end of the vane 135 and the inner circumferential surface of the cylinder 133, a normal force between the outer end of the vane 135 and the inner circumferential surface of the cylinder 133 may increase. Therefore, as a frictional force between the outer end of the vane 135 and the inner circumferential surface of the cylinder 133 increases, the rotation of the roller 134 may be interrupted, and thereby rotation efficiency may be lowered. Further, a shearing force may occur in the vane 135, and thereby the vane 135 may be damaged.

Also, when the pressure occurring in the close contact portion between the outer end of the vane 135 and the inner circumferential surface of the cylinder 133 is weak, the outer end of the vane 135 may be detached from the inner circumferential surface of the cylinder 133 and a flow of air between the chambers may occur. As a result, a compression rate may be lowered.

The pressure occurring in the close contact portion between the outer end of the vane and the inner circumferential surface of the cylinder may be a major factor affecting the efficiency and reliability of the rotary compressor, and thus, it is advantageous to optimize the pressure occurring in the close contact portion between the outer end of the vane 135 and the inner circumferential surface of the cylinder 133.

Figure 4:
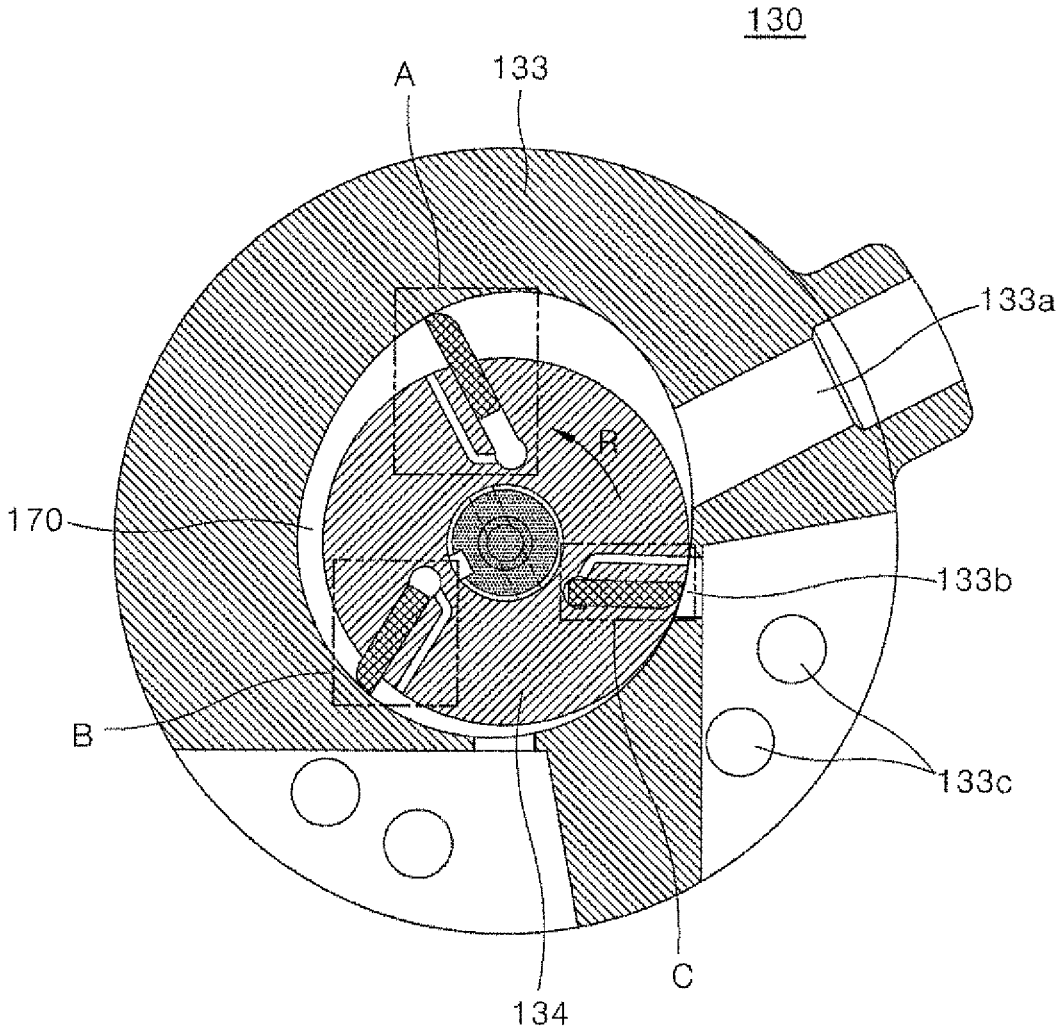
FIG. 4 is a view showing a structure of a rotary compressor in which a backpressure outlet is formed in a pocket portion according to an embodiment.
Figure 5:
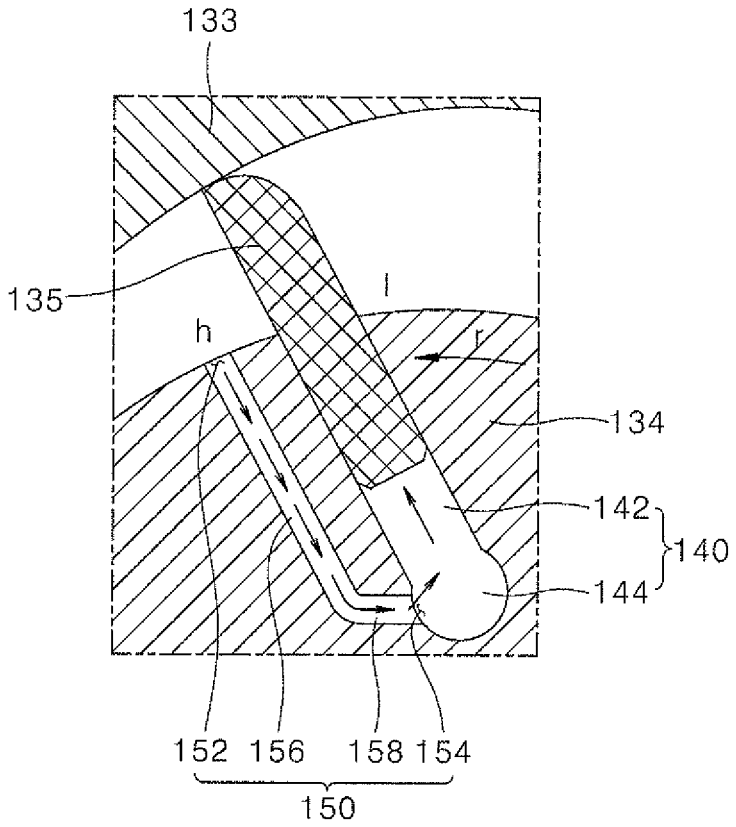
FIG. 5 is an enlarged view of a portion indicated by the letter "A" in FIG. 4.
Figure 6:
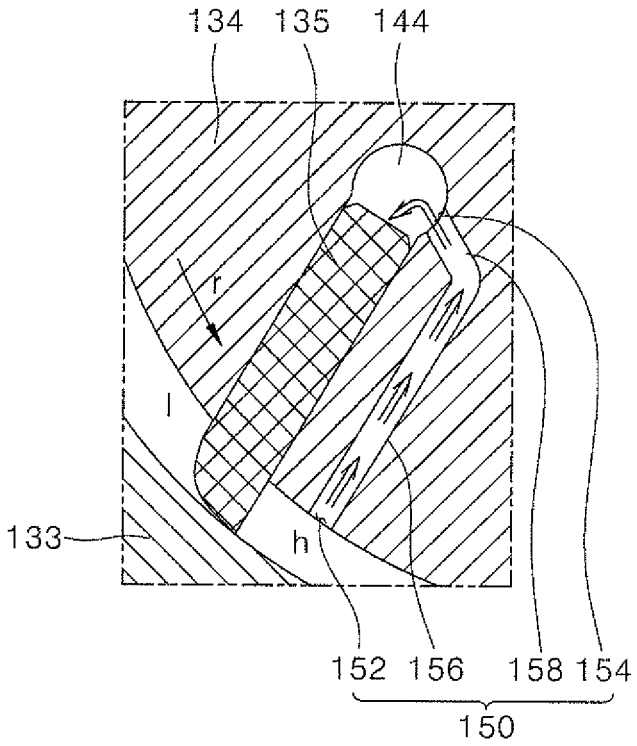
FIG. 6 is an enlarged view of a portion indicated by the letter "B" in FIG. 4.
Figure 7:
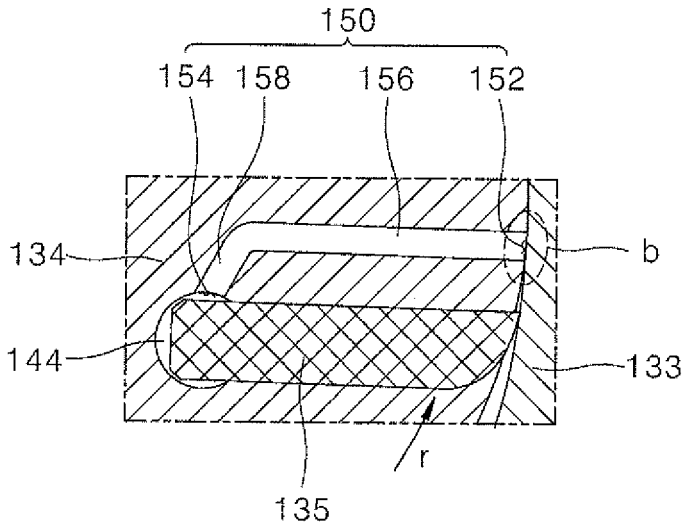
FIG. 7 is an enlarged view of a portion indicated by the letter "C" in FIG. 4.

FIG. 4 is a view showing a structure of a rotary compressor in which a backpressure outlet 154 is formed in pocket portion 144 according to an embodiment. FIG. 5 is an enlarged view of a portion indicated by the letter "A" in FIG. 4. FIG. 6 is an enlarged view of a portion indicated by the letter "B" in FIG. 4. FIG. 7 is an enlarged view of a portion indicated by the letter "C" in FIG. 4.

As shown in FIG. 4, the backpressure passage rotary compressor according to embodiments may be provided with a backpressure passage 150 formed in the roller 134. The compression chamber 170 may be partitioned into a plurality of chambers by the vane 135. A chamber disposed in front of the vane 135 along a rotational direction r of the roller 134 may have a higher rotation angle in comparison to a chamber disposed behind the vane 135. Therefore, in one compression cycle in which a refrigerant is suctioned and discharged, a pressure in the chamber disposed in front of the vane 135 may be maintained to be higher than a pressure in the chamber disposed behind the vane 135.

As shown in FIGS. 5 to 7, a chamber disposed in front of the vane 135 and a chamber disposed behind the vane 135 with the vane located therebetween may be a high-pressure chamber h and a low-pressure chamber l, respectively. Pressure of the high-pressure chamber h and pressure of the low-pressure chamber l may act on the vane 135 at the same time.

In one compression cycle in which a refrigerant is suctioned and discharged, the internal pressure of the high-pressure chamber h may gradually increase as the roller 134 rotates. The vane 135 may be more strongly adhered to the inner circumferential surface of the cylinder 133 so that a fluid in the high-pressure chamber h and a fluid in the low-pressure chamber l are not exchanged with each other as the internal pressure of the high-pressure chamber h gradually increases.

When the inner end of the vane 135 is pressurized by the pressure of the high-pressure chamber h, it is possible to prevent the outer end of the vane 135 from being detached from the inner circumferential surface of the cylinder 133. Therefore, the backpressure passage 150 may be formed on the outer circumferential surface of the roller 134, and may be provided with backpressure inlet 152 disposed in front of the vane slot 140 with respect to the rotational direction r of the roller 134 and the backpressure outlet 154 formed in the pocket portion 144 to allow the compression chamber 170 and the pocket portion 144 to communicate with each other.

As shown in FIGS. 5 and 6, fluid in the high-pressure chamber h may flow in through the backpressure inlet 152 formed in front of the vane slot 140, and may flow through the backpressure passage 150. Then, the fluid may flow into the pocket portion 144 through the backpressure outlet 154 formed in the pocket portion 144. As a result, the inner end of the vane 135 may be pressurized by the pressure of the high-pressure chamber h.

When a predetermined magnitude of backpressure is applied to the inner end of the vane 135, an interval in which an excessive magnitude of pressure is applied between the outer end of the vane 135 and the inner circumferential surface of the cylinder 133 may occur, and thereby the efficiency of the compressor may be lowered, and damage to a device may occur. However, when the inner end of the vane 135 is pressurized by the pressure of the high-pressure chamber h through the backpressure passage 150, a variable pressure may be provided to the outer end of the vane 135 according to a location in which the high-pressure chamber h is formed in the compression chamber 170.

Accordingly, the variable pressure may be applied with respect to a micro volume in the compression chamber 170, thereby preventing an excessive magnitude of pressure from being applied between the outer end of the vane 135 and the inner circumferential surface of the cylinder 133 while preventing the outer end of the vane 135 from being detached from the inner circumferential surface of the cylinder 133.

In the rotary compressor according to embodiments, a width of the pocket portion 144 of the vane slot 140 may be formed to be wider than a width of the slide portion 142. This is to apply pressure to the inner end of the vane 135 by smoothly introducing a fluid from the backpressure outlet 154 to the pocket portion 144 in a state in which the vane 135 is inserted into the vane slot 140 with the inner end of the vane 135 reaching the pocket portion 144.

According to one embodiment, the backpressure passage 150 connected from the backpressure inlet 152 to the backpressure outlet 154 may be provided with a backpressure inflow passage 156 configured to communicate with the backpressure inlet 152 and a backpressure discharge passage 158 configured to communicate with the backpressure outlet 154. The backpressure inflow passage 156 may extend in an inward direction of the roller 134 provided with the rotational shaft 123 from the backpressure outlet 154, and the backpressure discharge passage 158 may be bent from the backpressure inflow passage 156 and may be formed to extend in a direction of the backpressure outlet 154.

The backpressure passage 150 may be arranged on at least one of the upper side surface or the lower side surface of the roller 134 so that the backpressure passage 150 may be easily formed on the roller 134. This is because the backpressure passage 150 may be formed in an inward direction from the outer circumferential surface of the roller 134. Thus, when arranging the backpressure passage 150 on the upper side surface or the lower side surface of the roller 134, the backpressure passage 150 may be easily fabricated on the roller 134.

The first block 131 and second block 132 may be respectively provided on one or a first side surface and the other or a second side surface of the roller 134, and the roller 134 may rotate between the first block 131 and the second block 132. When the backpressure passage 150 is arranged on at least one of the upper side surface or the lower side surface of the roller 134, the roller may rotate in a state in which the roller 134 is in contact with the first block 131 and the second block 132. In process that a fluid flowing through the backpressure inflow passage 156 flows into the pocket portion 144 through the backpressure outlet 154, the fluid may leak into the vane slot 140 along a surface in which the roller 134 is in contact with the first block 131 and the second block 132.

Therefore, when the backpressure passage 150 is formed on at least one of the upper side surface or the lower side surface of the roller 134, the backpressure inflow passage 156 may be formed to extend in an inward direction from the backpressure inlet 152 in a state of being spaced apart from the vane slot 140. In order to prevent a fluid from leaking from the backpressure inflow passage 156 to the vane slot 140, a spacing distance between the vane slot 140 and the backpressure inflow passage 156 may be about 2 mm or more.

It is natural that the backpressure inflow passage 156 should be formed so as not to interfere with the vane slot 140 formed at front with respect to the rotational direction r of the roller 134 while the backpressure inflow passage 156 and the vane slot 140 are spaced apart from each other by about 2 mm or more. And, in order to prevent a fluid from leaking from the pocket portion 144 to the inner circumferential surface of the roller 134 into which the rotational shaft 123 is inserted, a spacing distance between the pocket portion 144 and the outer circumferential surface of the roller 134 may be about 2 mm or more.

Also, in order to prevent a fluid from leaking from the backpressure discharge passage 158 to the outer circumferential surface of the roller 134, a spacing distance between the backpressure discharge passage 158 and the outer circumferential surface of the roller 134 may be about 2 mm or more.

When a spacing distance is formed between the vane slot 140 and the backpressure inflow passage 156, the pocket portion 144 and the outer circumferential surface of the roller 134, and the backpressure discharge passage 158 and the outer peripheral surface of the roller 134, it is possible to prevent a leakage of the fluid flowing along a predetermined path, thereby improving the efficiency of the device.

A width and thickness of the backpressure passage 150 including the backpressure inflow passage 156 and the backpressure discharge passage 158 each may be about 1 mm or more (the width may be defined as a length with respect to the rotational direction r, and the thickness may be defined as a length with respect to a direction of the rotational shaft 123 that crosses the rotational direction r).

The roller 134 may rotate in the cylinder 133, and accordingly, a fluid and dust may flow into the compression chamber 170 formed by the outer circumferential surface of the roller 134 and the inner circumferential surface of the cylinder 133. When a minimum length of each of the width and thickness of the backpressure passage 150 is defined, it is possible to prevent the fluid and dust introduced into the compression chamber 170 from being accumulated in the backpressure passage 150 while flowing along the backpressure passage 150.

Figure 8:
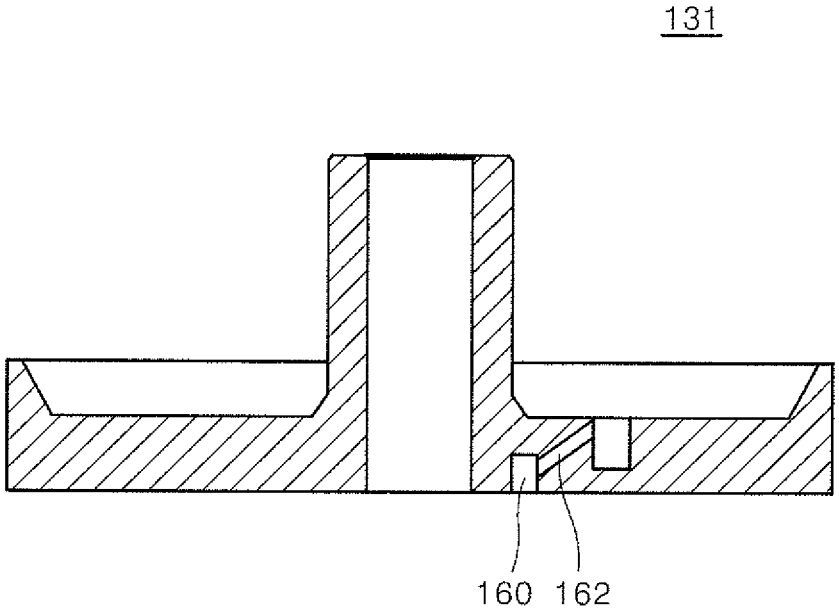
FIG. 8 is a side-sectional view of a first block provided with a discharge pressure groove capable of applying backpressure to a pocket portion.
Figure 9:
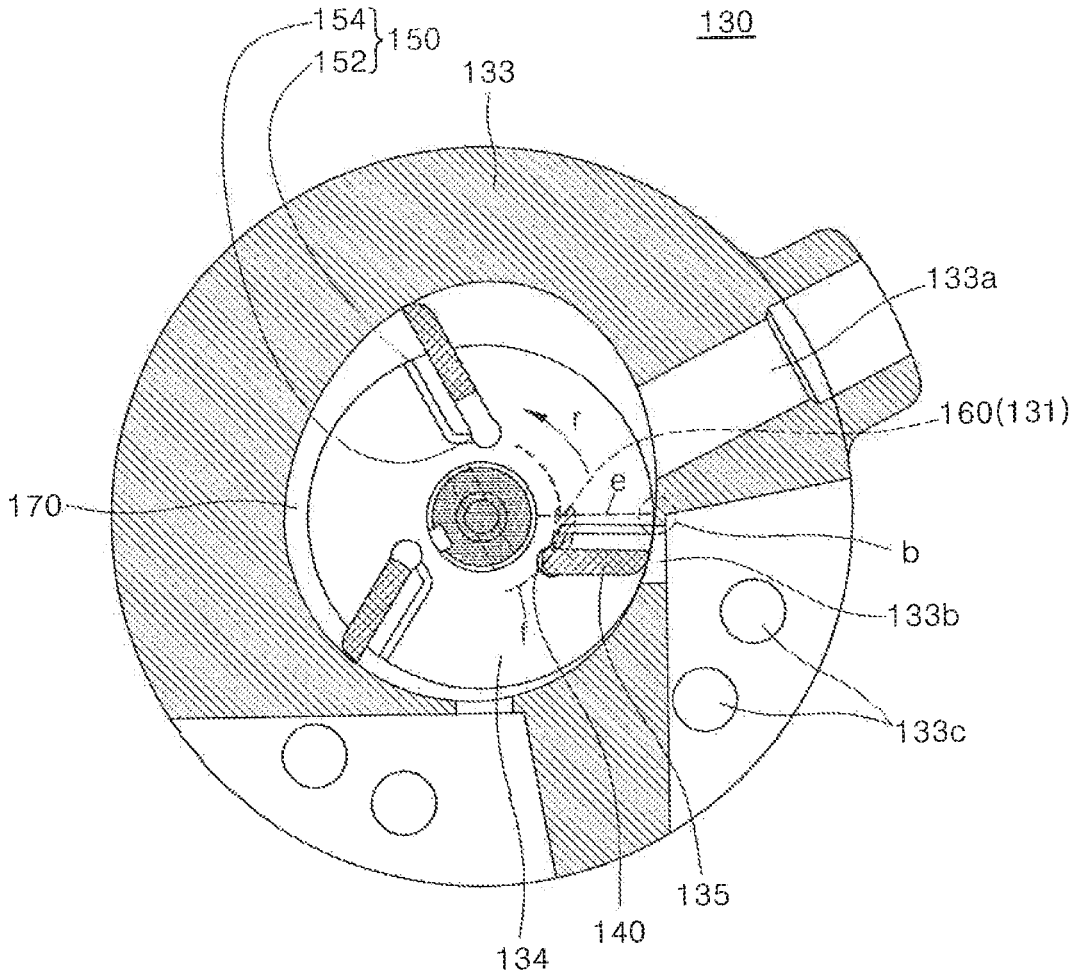
FIG. 9 is a view showing surfaces of a roller and a cylinder which are in close contact with one side surface of a first block provided with a discharge pressure groove.
Figure 10:
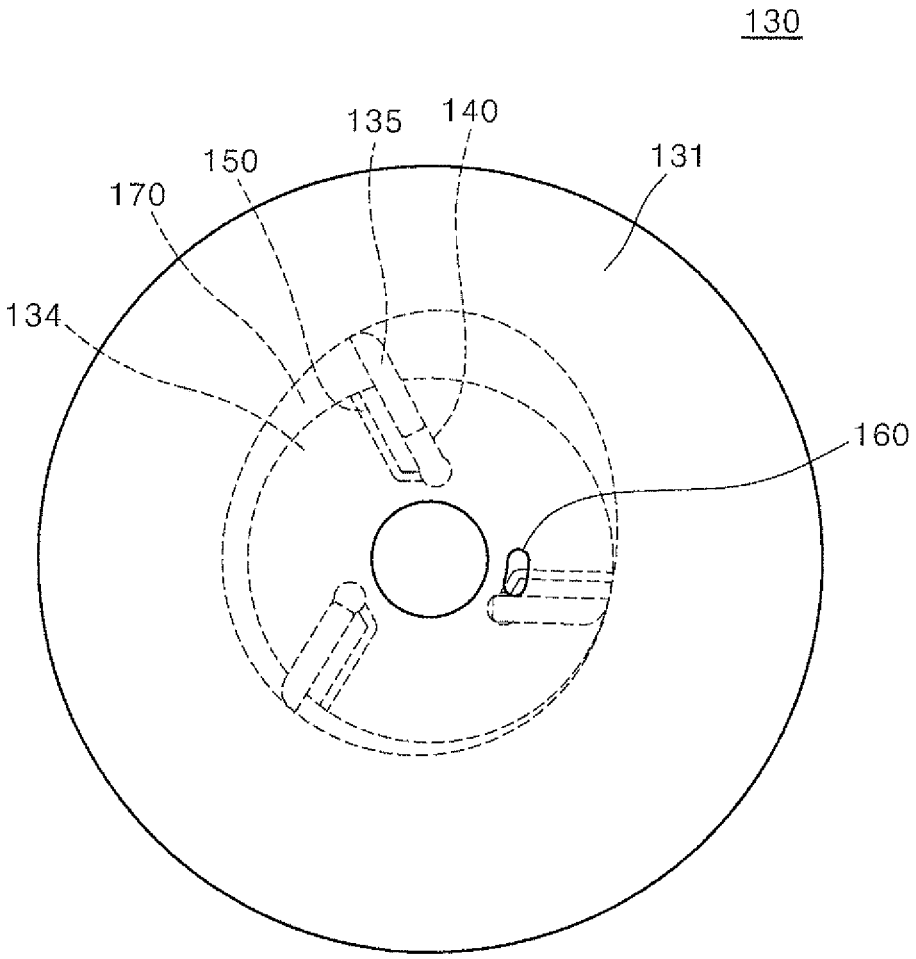
FIG. 10 is a view showing a surface of a first block provided with a discharge pressure groove which is in close contact with one side surfaces of a roller and a cylinder.

FIG. 8 is a side-sectional view of first block 131 provided with a discharge pressure groove 160 capable of applying backpressure to pocket portion 144, FIG. 9 is a view showing surfaces of roller 134 and cylinder 133 which are in close contact with one side surface of first block 131 provided with discharge pressure groove 160. FIG. 10 is a view showing a surface of first block 131 surface provided with the discharge pressure groove 160 which is in close contact with one side surface of roller 134 and cylinder 133.

FIGS. 8 to 10 each show a state in which the discharge pressure groove 160 is provided in the first block 131. At least one of a lower side surface of the first block 131 or an upper side surface of the second block 132 may be provided with the discharge pressure groove 160.

The roller 134 may rotate in the cylinder 133 while forming one contact point portion b on the inner circumferential surface of the cylinder 133. As shown in FIG. 7, when the backpressure passage 150 passes the contact point portion b, the backpressure inlet 152 may be closed by the inner circumferential surface of the cylinder 133. In a state in which the backpressure inlet 152 is closed, a fluid may not flow into or out of the pocket portion 144, and thus, an inner rear end of the vane 135 may not be pressurized. As a result, the outer end of the vane 135 may not be properly in close contact with the inner circumferential surface of the cylinder 133.

In a state in which the backpressure inlet 152 is closed by the inner circumferential surface of the cylinder 133, no more pressure may be applied from the high-pressure chamber h to the pocket portion 144. Thus, a predetermined magnitude of pressure may be applied to the pocket portion 144 when the backpressure passage 150 passes the contact point portion b while the roller 134 rotates.

Therefore, the discharge pressure groove 160 may be formed at a location that overlaps a rotational path of the pocket portion 144. Thus, when the pocket portion 144 passes between the discharge port 133*b* and the suction port 133*a* while rotating, the pocket portion 144 and the discharge pressure groove 160 may communicate with each other.

The discharge pressure groove 160 formed on the lower side surface of the first block 131 may communicate with an upper side surface of the first block 131 through a discharge pressure passage 162, and the discharge pressure groove 160 formed on the upper side surface of the second block 132 may communicate with a lower side surface of the second block 132 through the discharge pressure passage 162. An external discharge pressure of the cylinder 133 may be transferred to the discharge pressure groove 160 along the discharge pressure passage 162, and the discharge pressure may be applied to the pocket portion 144 at a point where the pocket portion 144 passes through the discharge pressure groove 160.

Referring to a location where the discharge pressure groove 160 is formed in detail, the discharge pressure groove 160 may be formed at a portion where a straight line e extending from the contact point portion b to the rotational shaft 123 and the rotational path f of the pocket portion 144 cross each other.

Figure 13:
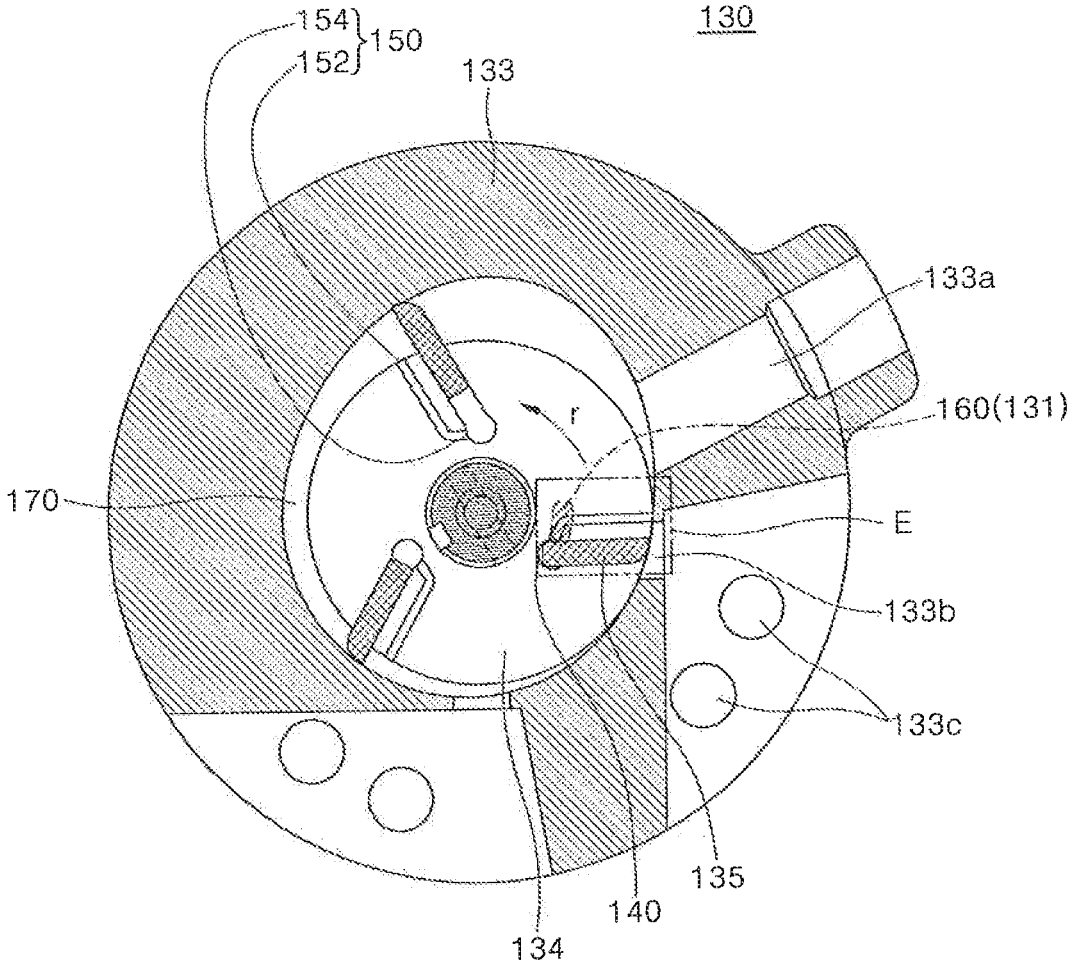
FIGS. 13-16 show, respectively, a time point when the back pressure inlet is closed by the inner circumferential surface of the cylinder and a time point when the back pressure inlet is opened, where
Figure 14:
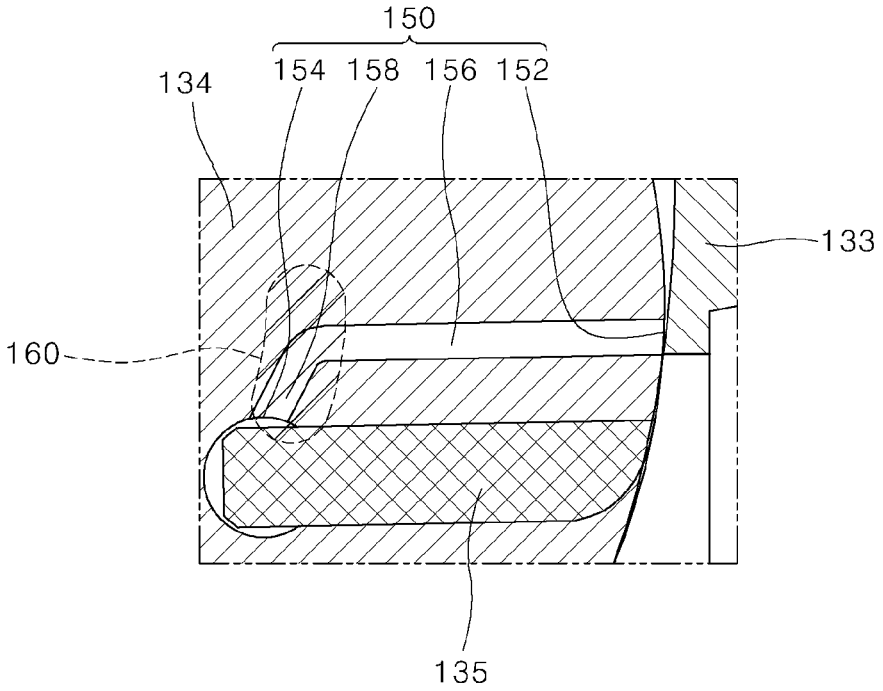
Figure 15:
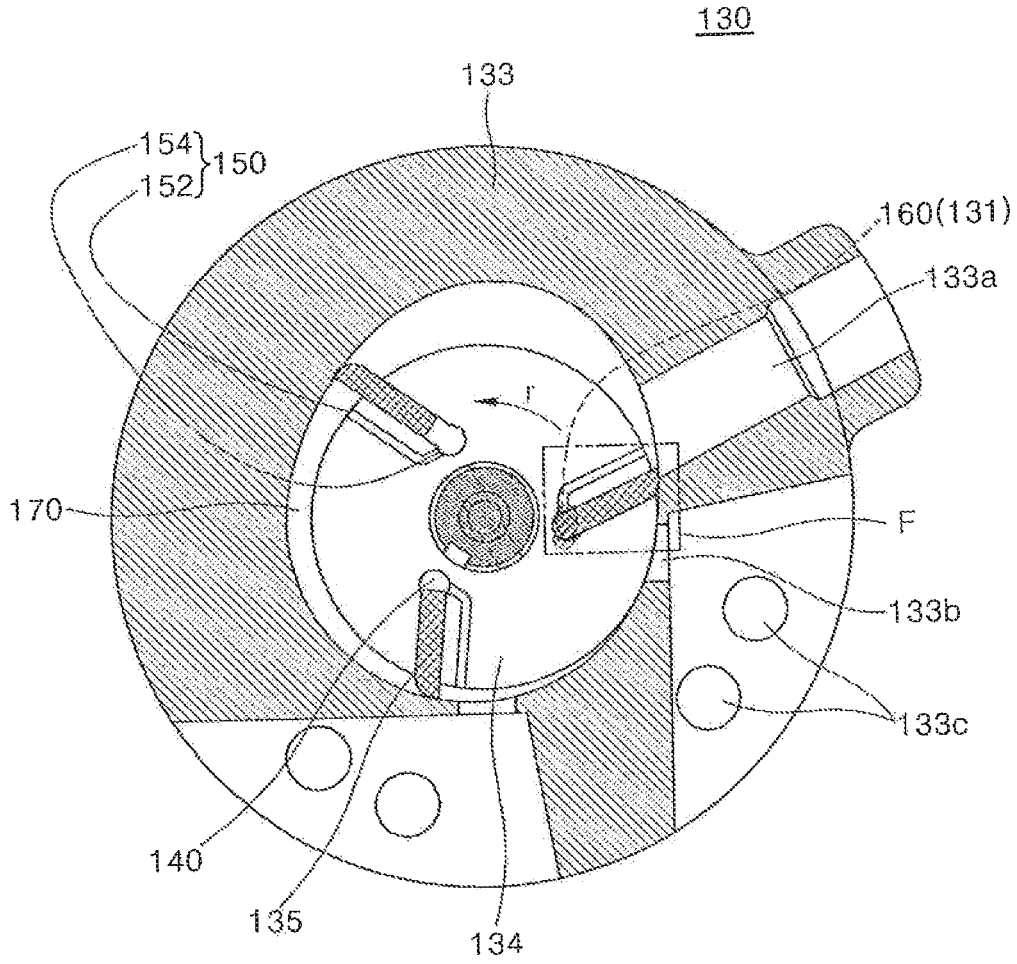
Figure 16:
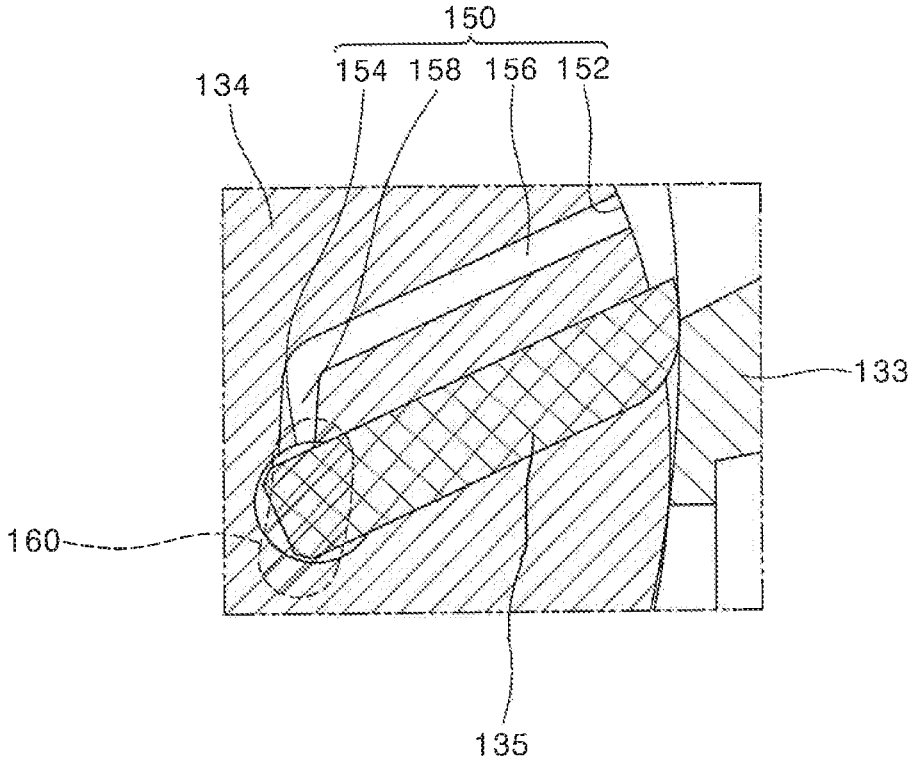

A size of the discharge pressure groove 160 may vary according to a spacing distance between the backpressure inflow passage 156 and the slide portion 142, and an angle at which the vane 135 is inserted into the roller 134, for example. The discharge pressure groove 160 may be formed to have a sufficient size to be able to apply the discharge pressure through the pocket portion 144 or the backpressure discharge passage 158 from a time point when the backpressure inlet 152 is closed by the inner circumferential surface of the cylinder 133 (see FIGS. 13-14) while the roller 134 rotates to a time point when the backpressure inlet 152 is opened (see FIGS. 15-16).

Figure 11:
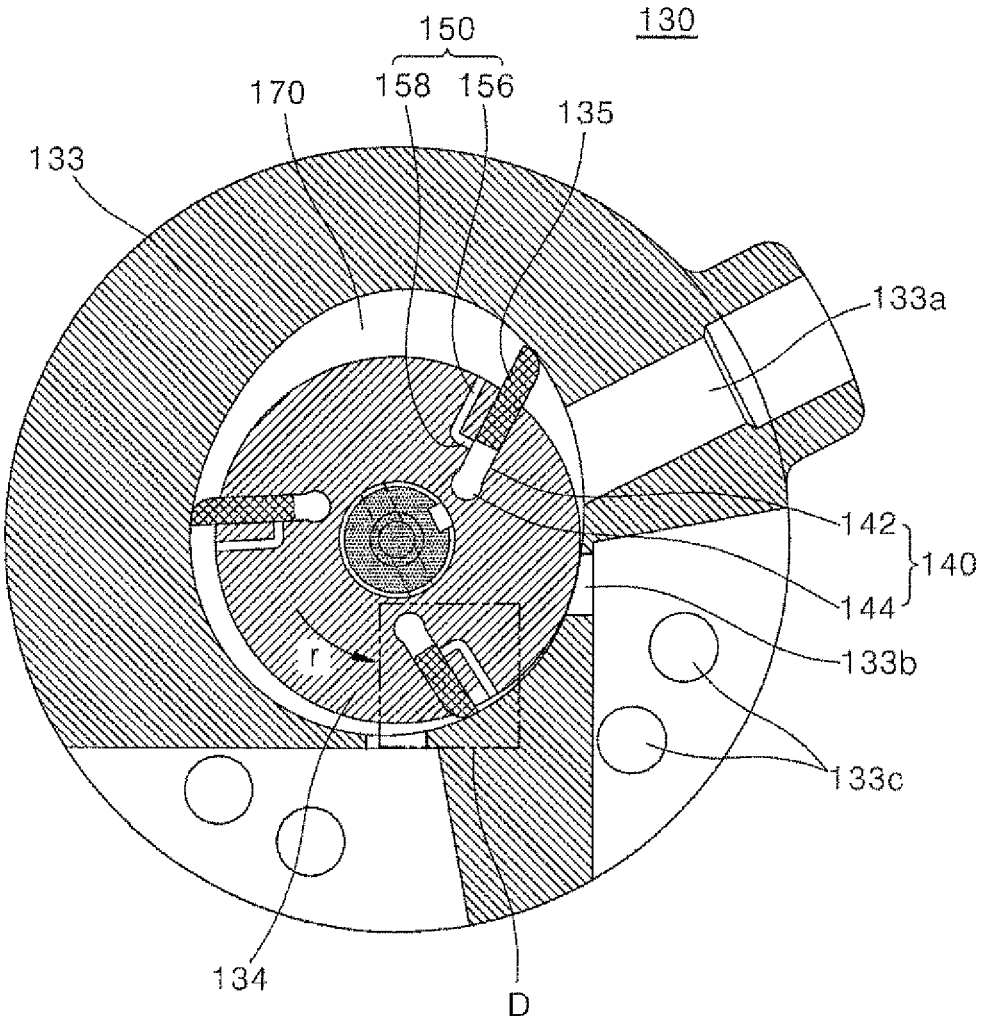
FIG. 11 is an enlarged view of an interior of a rotary compressor in which a backpressure outlet is formed in a slide portion according to an embodiment.
Figure 12:
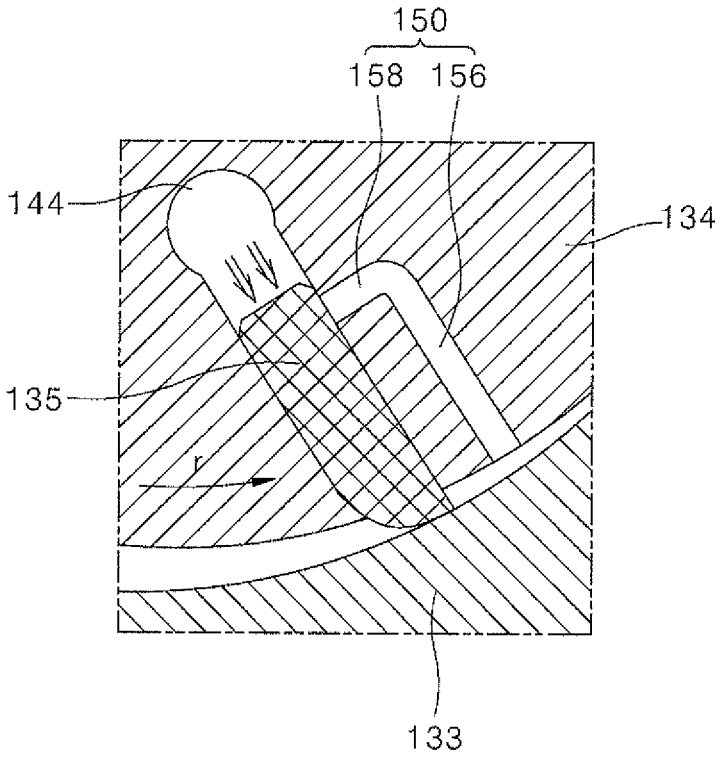
FIG. 12 is an enlarged view of a portion indicated by the letter "D" in FIG. 11.

FIG. 11 is an enlarged view of an interior of a rotary compressor in which backpressure outlet 154 is formed in slide portion 142 according to an embodiment. FIG. 12 is an enlarged view of a portion indicated by the letter "D" in FIG. 11.

As shown in FIG. 11, the backpressure rotary compressor 100 according to embodiments may be formed on the outer circumferential surface of the roller 134 and may be provided with the backpressure inlet 152 disposed in front of the vane slot 140 with respect to the rotational direction r of the roller 134 and the backpressure outlet 154 formed in the slide portion 144 to allow the compression chamber 170 and the slide portion 144 to communicate with each other. A length of the backpressure inflow passage 156 extending in a direction of the rotational shaft 123 from the backpressure inlet 152 may be formed to be shorter than a length of the slide portion 142, and the backpressure discharge passage 158 may be bent from the backpressure inflow passage 156 and may extend to the backpressure outlet 154 formed in the slide portion 142.

As shown in FIG. 12, when the backpressure outlet 154 is formed in the slide portion 142, the backpressure outlet 154 may be closed by a side surface of the vane 135 according to an extent to which to the vane 135 is inserted into the vane slot 140. That is, when the vane 135 is completely inserted into the vane slot 140, the backpressure outlet 154 may be closed by the side surface of the vane 135, and thus, a fluid in the high-pressure chamber h may not flow into the vane slot 140. The fluid in the high-pressure chamber h may flow into the vane slot 140 when the inner end of the vane 135 passes through the backpressure outlet 154 while the vane 135 slides outward.

Therefore, when the backpressure outlet 154 is formed in the slide portion 142, the pressure of the high-pressure chamber h may not be continuously transferred to the inner end of the vane 135. But, from a moment the inner end of the vane 135 passes through the backpressure outlet 154 while the vane slides outward, the pressure of the high-pressure chamber h may be transferred to the inner end of the vane 135.

On the other hand, from the moment the inner end of the vane 135 passes through the backpressure outlet 154 while the vane 135 slides inward, the inner end of the vane 135 may close the backpressure outlet 154, and the pressure of the high-pressure chamber h may not be transferred to the inner end of the vane 135.

From the moment the inner end of the vane 135 passes through the backpressure outlet 154, the vane 135 and the vane slot 140 may form one closed space. As the vane 135 slidably moves inward, a volume of the space formed by the vane slot 135 and the vane slot 140 may gradually decrease and pressure thereof may gradually increase. Thus, the inner end of the vane 135 may be pressurized by the pressure increasing in the space formed by the vane 135 and the vane slot 140.

When the backpressure outlet 154 is formed in the slide portion 142, a pressurized state of the inner end of the vane 135 may be maintained by the space formed by the vane 135 and the vane slot 140 even though the backpressure inlet 152 is closed by the inner circumferential surface of the cylinder 133 when the backpressure inlet 152 passes the contact point portion b while the roller 134 rotates.

Embodiments disclosed herein reduce a mechanical loss by supplying proper pressure to an inner end of a vane, thereby improving efficiency of a compressor. Embodiments disclosed herein further prevent an outer end of the vane from being detached from an inner wall surface of the cylinder by supplying proper pressure to the inner end of the vane, thereby ensuring airtightness of a compression chamber. Also, embodiments disclosed herein simplify a structure of a rotary compressor so that it can be easily manufactured can be easily manufactured and provide a structure in which proper pressure can be supplied to the inner end of the vane.

A backpressure passage rotary compressor according to embodiments disclosed herein may include a plurality of vanes, a vane slot configured to accommodate each of the vanes and provided with a pocket portion or pocket and a slide portion or slide, and a backpressure passage provided with a backpressure inlet disposed in front of the vane slot and a backpressure outlet formed in the pocket portion. The backpressure passage may perform a role of allowing a compression chamber and the pocket portion to communicate with each other. A width of the pocket portion may be formed to be wider than a width of the slide portion.

The backpressure passage may be formed on at least one of an upper side surface or a lower side surface of the roller. The backpressure passage may include a backpressure inflow passage extending in a direction of the rotational shaft from the backpressure inlet in a state of being spaced apart from the vane slot, and a backpressure discharge passage bent from the backpressure inflow passage and extending to the backpressure outlet. A spacing distance between the vane slot and the backpressure inflow passage may be about 2 mm or more.

The rotary compressor according to embodiments disclosed herein may include a first block and a second block respectively installed on one or a first side and the other or a second side of the cylinder. At least one of an inner side surface of the first block or an inner side surface of the second block may be provided with a discharge pressure groove at a portion where a straight line extending from the contact point portion to the rotational shaft and a rotational path of the pocket portion cross each other.

The backpressure rotary compressor according to embodiments disclosed herein may include a drive motor configured to generate a rotational force; a rotational shaft coupled to the drive motor to transfer a rotational force; a cylinder through which the rotational shaft passes, the cylinder configured to form a refrigerant accommodating space in which a refrigerant may be accommodated in a central portion thereof and provided with a suction port and a discharge port in a radial direction; a first block and a second block respectively installed on one or a first side surface and the other or a second side surface of the cylinder in a direction of the rotational shaft; a roller located in the cylinder so that one side thereof is in contact with an inner circumferential surface of the cylinder and configured to rotate together with the rotational shaft to form a compression chamber in the cylinder; a vane slot formed in the roller and provided with a pocket portion or pocket provided at an inner end thereof and a slide portion or slide connected to the compression chamber from the pocket portion; a plurality of vanes inserted into the vane slot, formed to protrude by backpressure applied to the vane slot to be in contact with an inner circumferential surface of the cylinder and configured to partition the compression chamber into a plurality of chambers; and a backpressure passage formed on an outer circumferential surface of the roller and provided with a backpressure inlet disposed in front of the vane slot with respect to a rotational direction of the roller and a backpressure outlet formed in the slide portion to allow the compression chamber and the slide portion to communicate with each other.

With the backpressure passage rotary compressor according to embodiments, proper pressure may be supplied to an inner end of a vane, thereby reducing a mechanical loss caused by pressure occurring in a close contact portion between an outer end of the vane and an inner circumferential surface of a cylinder. As a result, it is possible to improve efficiency of the compressor.

Further, with the backpressure passage rotary compressor according to embodiments, pressure may be properly supplied to the inner end of the vane, thereby preventing the outer end of the vane from being detached from an inner wall surface of the cylinder. As a result, it is possible to ensure airtightness of a compression chamber. Furthermore, with the backpressure passage rotary compressor according to embodiments, a structure of the rotary compressor may be simplified, thereby easily manufacturing the rotary compressor.

Embodiments described herein are not limited by the embodiments described herein and accompanying drawings. It should be apparent to those skilled in the art that various substitutions, changes and modifications which are not exemplified herein but are still within the spirit and scope may be made. The embodiments should be considered in descriptive sense only and not for purposes of limitation. Therefore, the scope is defined not by the detailed description but by the appended claim.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A backpressure rotary compressor, comprising:

a drive motor configured to generate a rotational force;

a rotational shaft coupled to the drive motor to transfer a rotational force;

a cylinder through which the rotational shaft passes, the cylinder provided with a suction port and a discharge port in a radial direction;

first and second blocks respectively installed at a first side and a second side of the cylinder in a direction in which the rotational shaft extends;

a roller provided in the cylinder so that only one side thereof is in contact with a contact point portion of an inner circumferential surface of the cylinder, the roller configured to rotate together with the rotational shaft in a rotational direction to form a compression chamber in the cylinder;

at least one vane slot formed in the roller, the at least one vane slot provided with a pocket portion arranged at an inner end thereof and a slide portion connected to the compression chamber from the pocket portion;

at least one vane inserted into the at least one vane slot, the at least one vane formed to protrude by backpressure applied to the at least one vane slot to contact the inner circumferential surface of the cylinder, and partition the compression chamber into a plurality of chambers;

a backpressure passage formed in the roller, the backpressure passage provided with a backpressure inlet disposed in front of the at least one vane slot with respect to the rotational direction of the roller and a backpressure outlet formed in the pocket portion to allow the compression chamber and the pocket portion to communicate with each other; and a discharge pressure groove provided on an inner side surface of the second first block on a radial side of the compression chamber where the contact point portion of the inner circumferential surface of the cylinder is disposed, the discharge pressure groove is sized to apply a discharge pressure to the pocket portion from a first time point when the backpressure inlet is closed by the inner circumferential surface of the cylinder while the roller rotates to a second time point when the backpressure inlet is opened to the compression chamber of the cylinder.

2. The backpressure passage rotary compressor of claim 1, wherein a width of the pocket portion is wider than a width of the slide portion.

3. The backpressure passage rotary compressor of claim 1, wherein the backpressure passage is formed on at least one of an upper side surface or a lower side surface of the roller.

4. The backpressure passage rotary compressor of claim 3, wherein the backpressure passage extends from the backpressure inlet to the backpressure outlet, and includes:

a backpressure inflow passage that extends in a direction of the rotational shaft from the backpressure inlet in a state of being spaced apart from the vane slot; and a backpressure discharge passage bent from the backpressure inflow passage and extending to the backpressure outlet.

5. A backpressure rotary compressor, comprising:

a drive motor configured to generate a rotational force;

a rotational shaft coupled to the drive motor to transfer a rotational force;

a cylinder through which the rotational shaft passes, the cylinder provided with a suction port and a discharge port in a radial direction;

a first block and a second block respectively installed at a first side and a second side of the cylinder in a direction in which the rotational shaft extends;

a roller located in the cylinder so that only one side thereof is in contact with an inner circumferential surface of the cylinder, the roller configured to rotate together with the rotational shaft in a rotational direction to form a compression chamber in the cylinder;

at least one vane slot formed in the roller, the at least one vane slot provided with a pocket portion provided at an inner end thereof and a slide portion connected to the compression chamber from the pocket portion;

at least one vane inserted into the at least one vane slot, the at least one vane formed to protrude by backpressure applied to the at least one vane slot to contact the inner circumferential surface of the cylinder, and partition the compression chamber into a plurality of chambers;

a backpressure passage formed in the roller, the backpressure passage provided with a backpressure inlet disposed in front of the at least one vane slot with respect to the rotational direction of the roller and a backpressure outlet formed in the slide portion to allow the compression chamber and the slide portion to communicate with each other; and a discharge pressure groove provided on an inner side surface of the first block on a radial side of the compression chamber where the contact point portion of the inner circumferential surface of the cylinder is disposed, the discharge pressure groove is sized to apply a discharge pressure to the pocket portion from a first time point when the backpressure inlet is closed by the inner circumferential surface of the cylinder while the roller rotates to a second time point when the backpressure inlet is opened to the compression chamber of the cylinder.

6. The backpressure passage rotary compressor of claim 5, wherein a width of the pocket is wider than a width of the slide portion.

7. The backpressure passage rotary compressor of claim 5, wherein the backpressure passage is formed on at least one of an upper side surface or a lower side surface of the roller.

8. The backpressure passage rotary compressor of claim 7, wherein the backpressure passage connected from the backpressure inlet to the backpressure outlet includes:

a backpressure inflow passage that extends in a direction of the rotational shaft from the backpressure inlet in a state of being spaced apart from the slide portion; and a backpressure discharge passage bent from the backpressure inflow passage and extending to the backpressure outlet.

9. The backpressure passage rotary compressor of claim 8, wherein a length of the backpressure inflow passage is shorter than a length of the slide portion.

10. A backpressure rotary compressor, comprising:

a drive motor configured to generate a rotational force;

a rotational shaft coupled to the drive motor to transfer a rotational force;

a cylinder through which the rotational shaft passes, the cylinder provided with a suction port and a discharge port in a radial direction;

first and second blocks respectively installed at a first side and a second side of the cylinder in a direction in which the rotational shaft extends;

a roller provided in the cylinder so that only one side thereof is in contact with a contact point portion of an inner circumferential surface of the cylinder, the roller configured to rotate together with the rotational shaft in a rotational direction to form a compression chamber in the cylinder;

a plurality of vane slots formed in the roller, the plurality of vane slots each provided with a pocket portion arranged at an inner end thereof and a slide portion connected to the compression chamber from the pocket;

a plurality of vanes inserted into the plurality of vane slots, respectively, the plurality of vanes formed to protrude by backpressure applied to the plurality of vane slots to contact the inner circumferential surface of the cylinder, and partition the compression chamber into a plurality of chambers;

a plurality of backpressure passages formed in the roller, the plurality of backpressure passages each provided with a backpressure inlet disposed in front of the respective vane slot with respect to the rotational direction of the roller and a backpressure outlet formed in the pocket portion to allow the compression chamber and the pocket portion to communicate with each other, wherein each of the plurality of backpressure passages extends from the respective backpressure inlet to the respective backpressure outlet, and includes:

a backpressure inflow passage that extends in a direction of the rotational shaft from the backpressure inlet in a state of being spaced apart from the respective vane slot; and a backpressure discharge passage bent from the backpressure inflow passage and extending to the backpressure outlet; and a discharge pressure groove provided on an inner side surface of the first block on a radial side of the compression chamber where the contact point portion of the inner circumferential surface of the cylinder is disposed, the discharge pressure groove is sized to apply a discharge pressure to the pocket portion from a first time point when the backpressure inlet is closed by the inner circumferential surface of the cylinder while the roller rotates to a second time point when the backpressure inlet is opened to the compression chamber of the cylinder.

11. The backpressure passage rotary compressor of claim 10, wherein a width of the pocket portion is wider than a width of the slide portion.

12. The backpressure passage rotary compressor of claim 10, wherein the backpressure passage is formed on at least one of an upper side surface or a lower side surface of the roller.

* * * * *